US009650581B2

(12) United States Patent
Earhart, Jr.

(10) Patent No.: US 9,650,581 B2
(45) Date of Patent: May 16, 2017

(54) SYSTEMS AND METHODS FOR EXTERNAL PROCESSING OF FLASH ZONE GAS OIL FROM A DELAYED COKING PROCESS

(71) Applicant: Bechtel Hydrocarbon Technology Solutions, Inc., Houston, TX (US)

(72) Inventor: Robert F Earhart, Jr., Plainview, TX (US)

(73) Assignee: Bechtel Hydrocarton Technology Solutions, Inc., Houston, TX (US)

( * ) Notice: Subject to any disclaimer, the term of this patent is extended or adjusted under 35 U.S.C. 154(b) by 0 days.

(21) Appl. No.: 14/777,299

(22) PCT Filed: Mar. 12, 2014

(86) PCT No.: PCT/US2014/024437

§ 371 (c)(1),
(2) Date: Sep. 15, 2015

(87) PCT Pub. No.: WO2014/150874

PCT Pub. Date: Sep. 25, 2014

(65) Prior Publication Data

US 2016/0024402 A1 Jan. 28, 2016

Related U.S. Application Data

(60) Provisional application No. 61/788,282, filed on Mar. 15, 2013.

(51) Int. Cl.
*C10G 47/00* (2006.01)
*C10G 69/00* (2006.01)
(Continued)

(52) U.S. Cl.
CPC ..... *C10G 69/06* (2013.01); *C10G 9/005* (2013.01); *C10G 47/00* (2013.01)

(58) Field of Classification Search
CPC ..... C10G 9/00; C10G 9/005; C10G 47/00; C10G 69/00; C10G 69/02; C10G 69/06;
(Continued)

(56) References Cited

U.S. PATENT DOCUMENTS 4,059,502 A * 11/1977 James ..... B01J 8/0015 208/152
4,750,985 A * 6/1988 Aldridge ..... C10G 69/06 208/108
(Continued)

FOREIGN PATENT DOCUMENTS

CN 103102984 A * 5/2013
CN 103102986 5/2013
WO WO 99/64540 A1 * 12/1999

OTHER PUBLICATIONS

Shane Thomas, International Search Report and Written Opinion of the International Searching Authority, PCT Application No. PCT/US14/24437, Jul. 7, 2014, 7 pages, International Searching Authority, US.

(Continued)

*Primary Examiner* — Natasha Young
(74) *Attorney, Agent, or Firm* — Crain, Caton & James

(57) ABSTRACT

Systems and methods for the external processing flash zone gas oil by recycling it through a vacuum residuum hydroprocessing unit before reentering the delayed coking process.

10 Claims, 3 Drawing Sheets

(51) Int. Cl.

| | |
|---|---|
| ***C10G 69/02*** | (2006.01) |
| ***C10G 69/06*** | (2006.01) |
| ***B01J 8/00*** | (2006.01) |
| ***B01J 8/18*** | (2006.01) |
| ***B01J 19/00*** | (2006.01) |
| ***B01J 19/24*** | (2006.01) |
| ***C10G 9/00*** | (2006.01) |

(58) Field of Classification Search
CPC ..... B01J 8/00; B01J 8/18; B01J 19/00; B01J 19/24
See application file for complete search history.

(56) References Cited

U.S. PATENT DOCUMENTS 5,013,427 A * 5/1991 Mosby ..... C10G 67/049 208/108
5,059,301 A 10/1991 Roussel et al.
5,645,711 A * 7/1997 Hraban ..... C10G 69/02 208/131
6,919,017 B2 7/2005 Annesley et al.
7,476,295 B2 * 1/2009 Annesley ..... B01J 8/0055 196/134
7,737,068 B2 * 6/2010 Powers ..... C10B 55/00 423/139
2005/0194290 A1 9/2005 Annesley
2007/0090018 A1 4/2007 Keusenkothen et al.
2008/0072476 A1 * 3/2008 Kennel ..... C10G 1/002 44/311
2010/0122932 A1 5/2010 Haizmann et al.
2010/0270208 A1 10/2010 Ward

OTHER PUBLICATIONS

Jennifer A Leung, International Preliminary Report on Patentability, PCT Application No. PCT/US14/24437, Feb. 6, 2015, 7 pages, International Preliminary Examining Authority, US.
Chi Wing Hung; Office Action dated Oct. 22, 2015; 4 pages; Patent Application No. 2,903,500; Canadian Intellectual Property Office; Canada.
Robert Feutlinske; Response to Office Action dated Oct. 22, 2015; Nov. 16, 2015; 3 pages; Patent Application No. 2,903,500; Kirby IP Canada; Canada.
Thoi Dai Chau, Extended European Search Report, Application No. 14769928.4, Sep. 30, 2016, 5 pages, European Patent Office, Munich Germany.
Zhou Fuke, Notification of the Second Office Action, Application No. 201480013177.3, Oct. 9, 2016, 7 pages, State Intellectual Property Office of the People's Republic of China, Beijing China.

* cited by examiner

SYSTEMS AND METHODS FOR EXTERNAL PROCESSING OF FLASH ZONE GAS OIL FROM A DELAYED COKING PROCESS

CROSS-REFERENCE TO RELATED APPLICATIONS

This Application claims priority from PCT Patent Application Serial No. PCT/US14/24437, now WO 2014/150874, filed on Mar. 12, 2014, which claims priority from U.S. Provisional Patent Application Ser. No. 61/788,282, filed on Mar. 15, 2013, which are incorporated herein by reference.

STATEMENT REGARDING FEDERALLY SPONSORED RESEARCH

Not applicable.

FIELD OF THE INVENTION

The present invention generally relates to systems and methods for the external processing of flash zone gas oil from a delayed coking process. More particularly, the present invention relates to the external processing of flash zone gas oil from a delayed coking process by recycling it through a vacuum residuum hydroprocessing unit before reentering the delayed coking process.

BACKGROUND OF THE INVENTION

The gas oil from the flash zone of a fractionator in a delayed coking process (hereinafter flash zone gas oil or "FZGO") is a heavier product with a higher boiling point and lower quality than heavy coker gas oil. Thus, it has few uses as a refinery intermediate feedstock and would normally be used to produce heavy fuel oil, which is a low-value product. FZGO is normally recycled back as feed to the heater in a conventional delayed coking process system. This recycle, also known as a natural recycle, consumes unit capacity and thus, replaces the fresh coker feed, also known as crude vacuum residuum feed, with a vacuum residuum feed that includes recycled FZGO. Almost all delayed coking processes recycle the FZGO to extinction within the delayed coking process and thus, no external product with FZGO is produced. As a result, the conventional delayed coking process produces a lower yield of higher valued products such as, for example, gas, naptha, light gas oil and heavy gas oil hereinafter referred to as lighter hydrocarbons. Additionally, the conventional delayed coking process produces a higher yield of low value petroleum coke.

In FIG. 1, a schematic diagram illustrates the recovery of FZGO in one embodiment of a standard delayed coking process system 100 that includes a heater 102, two coke drums 104, a fractionator 106 and a fractionator bottoms line 108. The fractionator bottoms line 108 includes vacuum residuum feed in the natural recycle that reenters the fractionator 106 with the crude vacuum residuum feed. The system 100 illustrates how a conventional delayed coking process system may be modified to remove FZGO as a separate product from the fractionator 106 for further processing or blending to produce fuel oil. Other separate products, such as gas, naptha, light coker gas oil and heavy coker gas oil, are also removed from the fractionator 106. Although the system 100 will increase the unit capacity in the heater 102 for crude vacuum residuum feed by removing FZGO from the natural recycle, the FZGO can be difficult to process as a separate product because it contains a high asphaltene content and a high metals content. The removed FZGO thus, may adversely affect the operations and reliability of standard fixed bed catalyst hydrocracking/hydrotreating.

There are several types of hydroprocessing that can be used to upgrade crude vacuum residuum to lighter hydrocarbon products, which is referred to hereinafter as vacuum residuum hydroprocessing. Vacuum residuum hydroprocessing may include, for example, any process that converts crude vacuum residuum with hydrogen and a catalyst into lighter molecules. Vacuum residuum hydroprocessing thus, includes fixed bed catalyst hydrocracking/hydrotreating, ebullated bed hydrocracking, and dispersed catalyst hydrocracking that crack the crude vacuum residuum into hydrocarbons such as gas, naptha, light gas oil and heavy gas oil.

In FIG. 2, a schematic diagram illustrates a vacuum residuum hydroprocessing unit 202 implemented with another embodiment of a standard delayed coking process system 200. The system 200 includes the same components as the standard delayed coking process system 100 in FIG. 1 except that the fractionator bottoms line 108 includes FZGO as part of the vacuum residuum feed in the natural recycle instead of removing FZGO as a separate product. The crude vacuum residuum enters the vacuum residuum hydroprocessing unit 202 for fixed bed catalyst hydrocracking/hydrotreating, ebullated bed hydrocracking or dispersed catalyst hydrocracking, which produces gas, naptha, light gas oil, heavy gas oil and another source of vacuum residuum feed in feed line 204 that represents unconverted (uncracked) oil. The process illustrated in FIG. 2 suffers from the same disadvantages as the conventional delayed coking process.

SUMMARY OF THE INVENTION

The present invention therefore, meets the above needs and overcomes one or more deficiencies in the prior art by providing systems and methods for the external processing of flash zone gas oil from a delayed coking process, by recycling it through a vacuum residuum hydroprocessing unit before reentering the delayed coking process.

In one embodiment, the present invention includes a system for external processing of flash zone gas oil from a delayed coking process, which comprises: i) a vacuum residuum hydroprocessing unit for converting the flash zone gas oil by one of ebullated bed hydrocracking and dispersed catalyst hydrocracking; ii) a delayed coking process system for producing the flash zone gas oil; iii) a flash zone gas oil line in fluid communication between the vacuum residuum hydroprocessing unit and the delayed coking process system for carrying only the flash zone gas oil from the delayed coking process system to the vacuum residuum hydroprocessing unit; and iv) a feed line in fluid communication between the vacuum residuum hydroprocessing unit and the delayed coking process system for carrying a vacuum residuum feed comprising unconverted flash zone gas oil from the vacuum residuum hydroprocessing unit to the delayed coking process system.

In another embodiment, the present invention includes a method for external processing of flash zone gas oil from a delayed coking process, which, comprises: i) producing flash zone gas oil from a delayed coking process system; ii) carrying only the flash zone gas oil from the delayed coking process system to a vacuum residuum hydroprocessing unit; iii) converting the flash zone gas oil in the vacuum residuum hydroprocessing unit by one of ebullated bed hydrocracking and dispersed catalyst hydrocracking; and iv) carrying a vacuum residuum feed comprising unconverted flash zone gas oil from the vacuum residuum hydroprocessing unit to the delayed coking process system.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings, in which like elements are referenced with like numerals, wherein.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other technologies. Moreover, although the term "step" may be used herein to describe different elements of methods employed, the term should not be interpreted as implying any particular order among or between various steps herein disclosed unless otherwise expressly limited by the description to a particular order. While the following description refers to external processing of delayed coker flash zone gas oil, the systems and methods of the present invention are not limited thereto and may include other applications in which the processing may be applied to achieve similar results.

Figure 1:
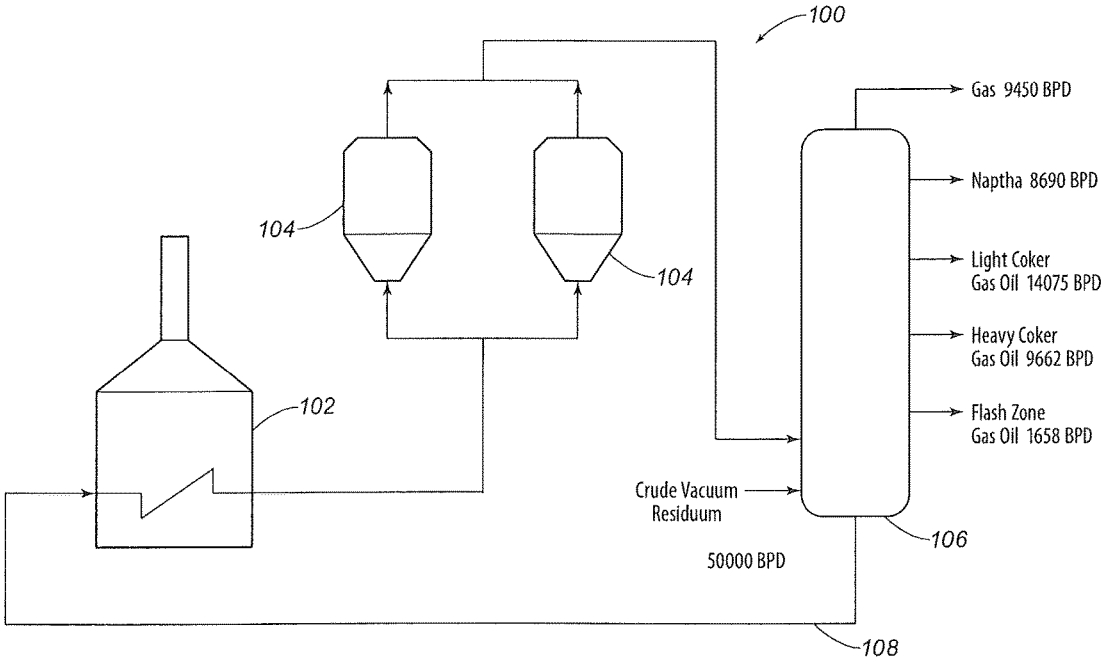
FIG. 1 is a schematic diagram illustrating the recovery of flash zone gas oil in one embodiment of a standard delayed coking process system.
Figure 2:
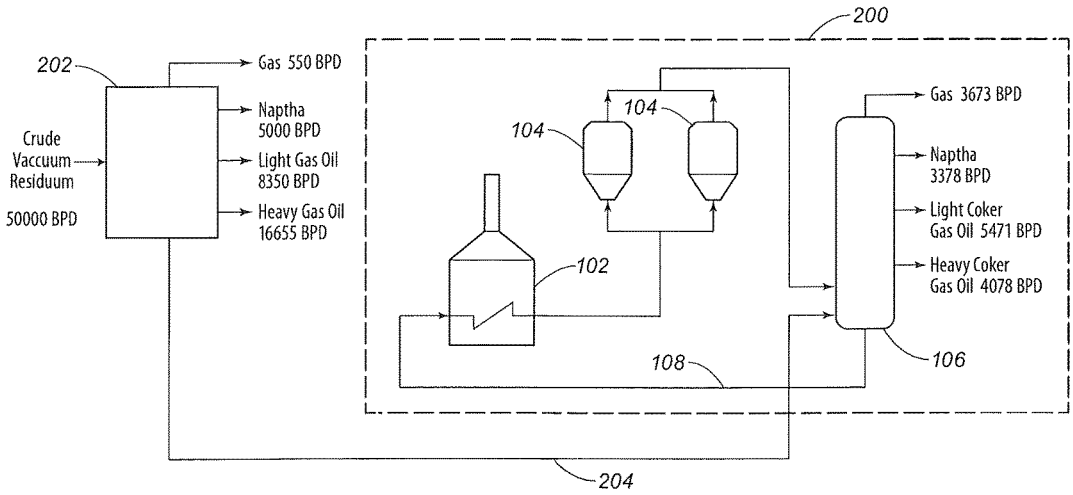
FIG. 2 is a schematic diagram illustrating a standard vacuum residuum hydroprocessing unit implemented within another embodiment of a standard delayed coking process system.
Figure 3:
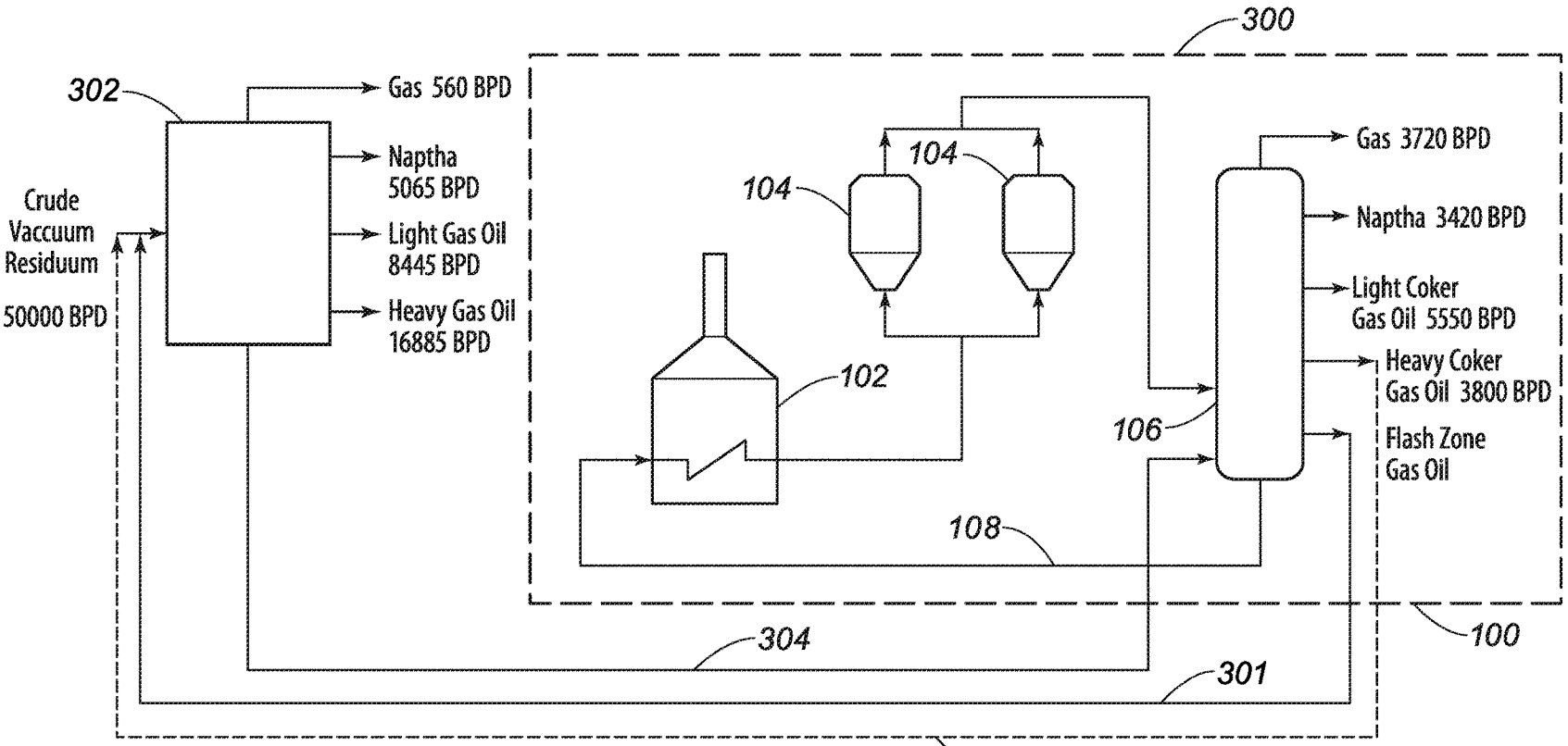
FIG. 3 is a schematic diagram illustrating another vacuum residuum hydroprocessing unit implemented within another embodiment of a delayed coking process system according to the present invention.

Referring now to FIG. 3, a schematic diagram illustrates another vacuum residuum hydroprocessing unit 302 implemented within another embodiment of a delayed coking process system 300 according to the present invention. The system 300 includes the same components as the standard delayed coking process system 100 in FIG. 1 except that the FZGO is returned to the vacuum residuum hydroprocessing unit 302 through FZGO line 301 instead of removing it for further processing or blending to produce fuel oil. The crude vacuum residuum enters the vacuum residuum hydroprocessing unit 302 mixed with the FZGO for ebullated bed hydrocracking or dispersed catalyst hydrocracking, which produces gas, naptha, light gas oil, heavy gas oil and another source of vacuum residuum feed for feed line 304 that includes unconverted (uncracked) FZGO. Because the conversion level within the vacuum residuum hydroprocessing unit 302 is relatively low (approx. 65%), the unconverted FZGO is recycled back to the system 300 until extinction. In this manner, the FZGO is recycled between the fractionator 106 and the vacuum residuum hydroprocessing unit 302, instead of sending it to a low-value disposition for further processing as illustrated in FIG. 1 or naturally recycling it as illustrated in FIG. 2, which yields more valuable light fuel products. In other words, removing the FZGO and returning it to the vacuum residuum hydroprocessor unit 302 for ebullated bed hydrocracking or dispersed catalyst hydrocracking converts much of the FZGO to higher quality lighter hydrocarbon products than if the FZGO remained in the natural recycle of the system 300. And, if the FZGO was processed in a vacuum residuum hydroprocessor designed for fixed bed catalyst hydrocracking/hydrotreating, the only product removed would be a low-value low-sulfur fuel oil.

Optionally, the Heavy Coker Gas Oil removed from the fractionator 106 may also be returned to the vacuum residuum hydroprocessing unit 302 through a heavy coker gas oil ("HCGO") line 306. In this embodiment, the crude vacuum residuum enters the vacuum residuum hydroprocessing unit 302 mixed with the FZGO and the HCGO for producing the same products with a higher quality. In other words, the vacuum residuum hydroprocessing unit 302 is designed to handle FZGO much better than if it were designed for fixed bed catalyst hydrocracking/hydrotreating.

When FZGO is recycled within the natural recycle of a delayed coking process, approximately 50% of the FZGO is converted to coke while the rest is upgraded to more valuable lighter hydrocarbons. If the FZGO is removed from the delayed coking process and returned to the vacuum residuum hydroprocessing unit as illustrated in FIG. 3, then approximately 65% of the FZGO is converted to lighter hydrocarbons and the remaining unconverted FZGO is sent as feed to the delayed coking process where approximately 50% is converted to lighter hydrocarbons. Approximately 82% of the FZGO therefore, can be converted (upgraded), rather than 50% if it remains in the natural recycle of a delayed coking process.

EXAMPLE

In this example, three cases are presented that represent the processes illustrated in FIGS. 1-3, respectively. Representative yields for the three cases are illustrated in FIGS. 1-3 and Table 1 (below), which are based upon a crude oil slate of 50% Arabian Light crude oil and 50% Arabian Heavy crude oil. The representative yields are also based on a 65% conversion of FZGO by weight in the vacuum residuum hydroprocessing unit (VR HP Unit). With Case 1 being the base, Case 2 represents an increase of 8.3% in the yield of lighter hydrocarbons. Case 3 represents an increase of 9.0% over Case 1 and 0.6% over Case 2. For a refinery with 50,000 barrels per day (BPD) of vacuum residuum, Case 2 shows an increase of 3,620 barrels per day of total liquid products over Case 1; however, 1,658 barrels per day of that production is FZGO, which can only be used for low-value residual fuel oil and not upgraded to transportation fuels. Case 3 shows an increase of 3,909 barrels per day over Case 1 and 289 barrels per day over Case 2.

TABLE 1

| | Units | Case 1 | Case 2 | Case 3 |
|---|---|---|---|---|
| Vacuum Residuum | BPD | 50000 | 50000 | 50000 |
| Feed to VR HP Unit | BPD | | 50000 | 50655 |
| Conversion | Wt. % | | 65.0% | 65.0% |
| C4- Yield | Vol. % | | 1.1% | 1.1% |
| C5-350F Yield | Vol. % | | 10.0% | 10.0% |
| 350F-650F yield | Vol. % | | 16.7% | 16.7% |
| 650F-950F | Vol. % | | 33.3% | 33.3% |
| 950F + Yield | Vol. % | | 38.9% | 38.9% |
| Unconverted Oil | BPD | | 19435 | 19689 |

TABLE 1-continued

| | Units | Case 1 | Case 2 | Case 3 |
|---|---|---|---|---|
| (FZGO) | | | | |
| Feed to Fractionator | BPD | 50000 | 19435 | 19689 |
| C4- Yield | Vol. % | 18.9% | 18.9000% | 18.9% |
| C5-350F Yield | Vol. % | 17.4% | 17.3800% | 17.4% |
| 350F-650F yield | Vol. % | 28.2% | 28.1500% | 28.2% |
| 650F-950F Yield | Vol. % | 19.3% | 20.9820% | 19.3% |
| FZGO Yield | Vol. % | 3.3% | 0.0000% | 3.3% |
| Coke Yield | Wt. % | 31.0% | 33.3% | 31.0% |
| VR HP 950- Products | BPD | 0 | 30555 | 30954 |
| Coker HCGO - Products | BPD | 41877 | 16600 | 16490 |
| Coker FZGO Product | BPD | 1658 | 0 | 0 |
| Total Liquid Products | BPD | 43535 | 47155 | 47444 |
| Percent Increase | % | Base | 8.3% | 9.0% |
| Increase over Case 2 | | | Base | 0.6% |
| Total C4- Products (Gas) | BPD | 9450 | 4228 | 4283 |
| C5-350F Product (Naptha) | BPD | 8690 | 8378 | 8487 |
| 350F-650F Product (Light Coker Gas Oil and Light Gas Oil) | BPD | 14075 | 13806 | 13986 |
| 650F-950F Product (Heavy Coker Gas Oil and Heavy Gas Oil) | BPD | 9662 | 20743 | 20687 |
| FZGO Product (FZGO) | BPD | 1658 | 0 | 0 |

As demonstrated by the foregoing example, the process illustrated in FIG. 3 improves the yield of total liquid products and significantly reduces the amount of HCGO products compared to the processes illustrated in FIGS. 1-2. In addition, the process illustrated in FIG. 3 also increases the yield of lighter hydrocarbons compared to the processes illustrated in FIGS. 1-2, While the present invention has been described in connection with presently preferred embodiments, it will be understood by those skilled in the art that it is not intended to limit the invention to those embodiments. It is therefore, contemplated that various alternative embodiments and modifications may be made to the disclosed embodiments without departing from the spirit and scope of the invention defined by the appended, claims and equivalents thereof.

The invention claimed is:

1. A system for external processing of flash zone gas oil from a delayed coking process, which comprises:

a vacuum residuum hydroprocessing unit for converting the flash zone gas oil by one of ebullated bed hydrocracking and dispersed catalyst hydrocracking;

a delayed coking process system for producing the flash zone gas oil;

a flash zone gas oil line in fluid communication between the vacuum residuum hydroprocessing unit and the delayed coking process system for carrying only the flash zone gas oil from the delayed coking process system to the vacuum residuum hydroprocessing unit; and a feed line in fluid communication between the vacuum residuum hydroprocessing unit and the delayed coking process system for carrying a vacuum residuum feed comprising unconverted flash zone gas oil from the vacuum residuum hydroprocessing unit to the delayed coking process system.

2. The system of claim 1, wherein at least 80% of the flash zone gas oil is converted by the vacuum residuum hydroprocessing unit to lighter hydrocarbons.

3. The system of claim 2, wherein the lighter hydrocarbons comprise at least one of gas, naptha, light gas oil and heavy gas oil.

4. The system of claim 1, wherein the flash zone gas oil line carries unfiltered flash zone gas oil directly from the delayed coking process system to the vacuum residuum hydroprocessing unit.

5. The system of claim 1, wherein the feed line carries the vacuum residuum feed directly from the vacuum residuum hydroprocessing unit to the delayed coking process system.

6. A method for external processing of flash zone gas oil from a delayed coking process, which comprises:

producing flash zone gas oil from a delayed coking process system;

carrying only the flash zone gas oil from the delayed coking process system to a vacuum residuum hydroprocessing unit;

converting the flash zone gas oil in the vacuum residuum hydroprocessing unit by one of ebullated bed hydrocracking and dispersed catalyst hydrocracking; and carrying a vacuum residuum feed comprising unconverted flash zone gas oil from the vacuum residuum hydroprocessing unit to the delayed coking process system.

7. The method of claim 6, wherein at least 80% of the flash zone gas oil is converted by the vacuum residuum hydroprocessing unit to lighter hydrocarbons.

8. The method of claim 7, wherein the lighter hydrocarbons comprise at least one of gas, naptha, light gas oil and heavy gas oil.

9. The method of claim 6, wherein the flash zone gas oil line carries unfiltered flash zone gas oil directly from the delayed coking process system to the vacuum residuum hydroprocessing unit.

10. The method of claim 6, wherein the feed line carries the vacuum residuum feed directly from the vacuum residuum hydroprocessing unit to the delayed coking process system.

* * * * *